US009395645B2

(12) United States Patent
Barry et al.

(10) Patent No.: US 9,395,645 B2
(45) **Date of Patent: *Jul. 19, 2016**

(54) CAPACITIVE TONER LEVEL SENSOR

(71) Applicant: Lexmark International, Inc., Lexington, KY (US)

(72) Inventors: Raymond Jay Barry, Lexington, KY (US); James Anthany Carter, II, Lexington, KY (US); Gregory Alan Cavill, Winchester, KY (US); Michael Craig Leemhuis, Nicholasville, KY (US); Benjamin Keith Newman, Lexington, KY (US); Joshua Carl Poterjoy, Georgetown, KY (US); Keisha Josephine Thomas, Hillsboro, OR (US); Jason Carl True, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/246,910

(22) Filed: Apr. 7, 2014

(65) Prior Publication Data

US 2015/0301474 A1 Oct. 22, 2015
US 2016/0154337 A9 Jun. 2, 2016

Related U.S. Application Data

(63) Continuation of application No. 13/340,789, filed on Dec. 30, 2011, now Pat. No. 8,718,496.

(51) Int. Cl.
*G03G 15/08* (2006.01)

(52) U.S. Cl.
CPC ..... *G03G 15/0812* (2013.01); *G03G 15/086* (2013.01); *G03G 15/0856* (2013.01); *G03G 15/0889* (2013.01); *G03G 2215/0888* (2013.01)

(58) Field of Classification Search
CPC combination set(s) only.
See application file for complete search history.

(56) References Cited

U.S. PATENT DOCUMENTS 4,133,453 A 1/1979 Ohbora
5,987,269 A 11/1999 Allen et al.

(Continued)

FOREIGN PATENT DOCUMENTS

JP S5550273 4/1980
JP H0451064 2/1992

(Continued)

OTHER PUBLICATIONS

International Search Report and Written Opinion of the International Searching Authority for PCT application PCT/US12/72009, Mar. 8, 2013.

(Continued)

*Primary Examiner* — Clayton E Laballe
*Assistant Examiner* — Jas Sanghera

(57) ABSTRACT

A toner container including a first electrode disposed within the toner container, a second electrode electrically connected to the first electrode and disposed within the toner container, and a sense electrode disposed between the first electrode and the second electrode. The sense electrode and the first electrode form a first capacitor having a first capacitance that changes in response to a change in toner amount existing therebetween. The sense electrode and the second electrode form a second capacitor having a second capacitance that changes in response to a change in toner amount existing therebetween.

19 Claims, 6 Drawing Sheets

(56) References Cited

U.S. PATENT DOCUMENTS

| | | | | |
|---|---|---|---|---|
| 7,555,231 | B2 | 6/2009 | Etter et al. | |
| 8,718,496 | B2 | 5/2014 | Barry et al. | |
| 2002/0172521 | A1 | 11/2002 | Oguma et al. | |
| 2003/0016955 | A1* | 1/2003 | Hiratsuka et al. | 399/27 |
| 2003/0123888 | A1 | 7/2003 | Naito et al. | |
| 2007/0206965 | A1 | 9/2007 | Namiki et al. | |
| 2008/0069576 | A1 | 3/2008 | Etter et al. | |

FOREIGN PATENT DOCUMENTS

| | | |
|---|---|---|
| JP | 1-144075 | 11/2002 |
| JP | 2003323036 | 11/2003 |

OTHER PUBLICATIONS

Extended European Search Report for counterpart EP application 12863285.8, dated Jul. 1, 2015.

* cited by examiner

CAPACITIVE TONER LEVEL SENSOR

CROSS REFERENCES TO RELATED APPLICATIONS

Pursuant to 37 C.F.R. §1.78, this application is a continuation application and claims the benefit of the earlier filing date of application Ser. No. 13/340,789, filed Dec. 30, 2011, entitled "Capacitive Toner Level Sensor," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic imaging devices such as a printer or multifunction device having printing capability, and in particular to a toner level sensor in a toner container of the imaging device.

2. Description of the Related Art

Image forming devices such as copiers, laser printers, facsimile machines and the like typically use one or more toner containers to hold toner supply used for image forming processes. In some image forming devices, a large toner supply is provided in a reservoir in a toner cartridge that mates with a separate imaging unit. The imaging unit may include a sump that holds a smaller amount of toner, enough to ensure toner is adequately supplied by a toner adder roll and a developer roll to a photoconductive drum. As toner within the imaging unit sump is depleted due to printing operations, additional toner is transferred from the toner cartridge to the imaging unit sump.

To ensure satisfactory operation of the imaging unit to transfer toner, the toner level within the imaging unit sump is maintained at a proper level. For example, if the imaging unit sump holds too much toner, toner may pack in the imaging unit sump, leak out of the ports and eventually break other components located inside and outside the imaging lip unit. If the toner level in the imaging unit sump gets too low, the toner adder roll may starve, causing a doctor blade of the imaging unit to film and damage the developer roll which may eventually impair the future performance of the imaging unit. As such, it is desirable to know the toner level in the imaging unit sump so as to effectively determine when to move toner from toner cartridge to the imaging unit sump.

Some methods for determining toner level in a container use estimates of toner use and accumulation based on print or time counts. However, these methods may not be accurate due to variability in factors such as the environment, developer roll age, toner patch sensing cycles, and toner transfer parameters.

Other known techniques for sensing or determining toner level include the use of electrical sensors that measure the motive force required to drive an agitator within a toner container, optical devices including mirrors and toner dust wipers in a container, and other opto-electromechanical devices such as a flag that moves with the toner level to actuate a sensor that triggers only when the volume reaches a predetermined level. Unfortunately, the addition of moving hardware increases component complexity and opportunities for errors.

Another existing solution provides two parallel plates disposed within the interior of a toner container for detecting toner volume levels. The two parallel plates form a capacitor having a capacitance that varies with the amount of toner existing between the two parallel plates. This solution, however, may not provide a sufficiently accurate means for detecting toner levels in a toner container because of lack of sensitivity to small changes in toner level.

Based upon the foregoing, there is a need for toner level sensing that is more sensitive to changes in toner level within a toner container, without substantially increasing manufacturing costs.

SUMMARY

Embodiments of the present disclosure provide a capacitive sensor for detecting toner level in a toner container. In an example embodiment, to a toner container includes a first electrode disposed within the toner container, a second electrode electrically connected to the first electrode and disposed within the toner container opposite the first electrode, and a sense electrode disposed between the first electrode and the second electrode. The sense electrode and the first electrode form a first capacitor having a first capacitance that changes in response to a change in toner amount existing therebetween. The sense electrode and the second electrode form a second capacitor in parallel with the first capacitor and having a second capacitance that changes in response to a change in toner amount existing therebetween.

In another example embodiment, a toner container includes at least one mechanism for handling toner within the toner container and at least two electrodes disposed within the toner container. The at least two electrodes includes a component of the at least one mechanism that handles toner within the toner container. The at least two electrodes form at least one capacitor having a capacitance that changes in response to a change in an amount of toner existing between the at least two electrodes. The one of the at least two to electrodes having the component of the at least one toner handling mechanism includes one of a gutter for distributing toner substantially evenly across the toner container and a doctor blade for removing and/or leveling a part of a toner layer on a developer roller of the toner container.

In another example embodiment, a toner container includes a plurality of electrodes disposed within the toner container. The electrodes form at least one capacitor having a capacitance that changes in response to a change in an amount of toner existing between the plurality of electrodes. The plurality of electrodes includes at least one first electrode and a second electrode. The at least one first electrode at least partly surrounds the second electrode so as to provide electrical shielding thereto.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
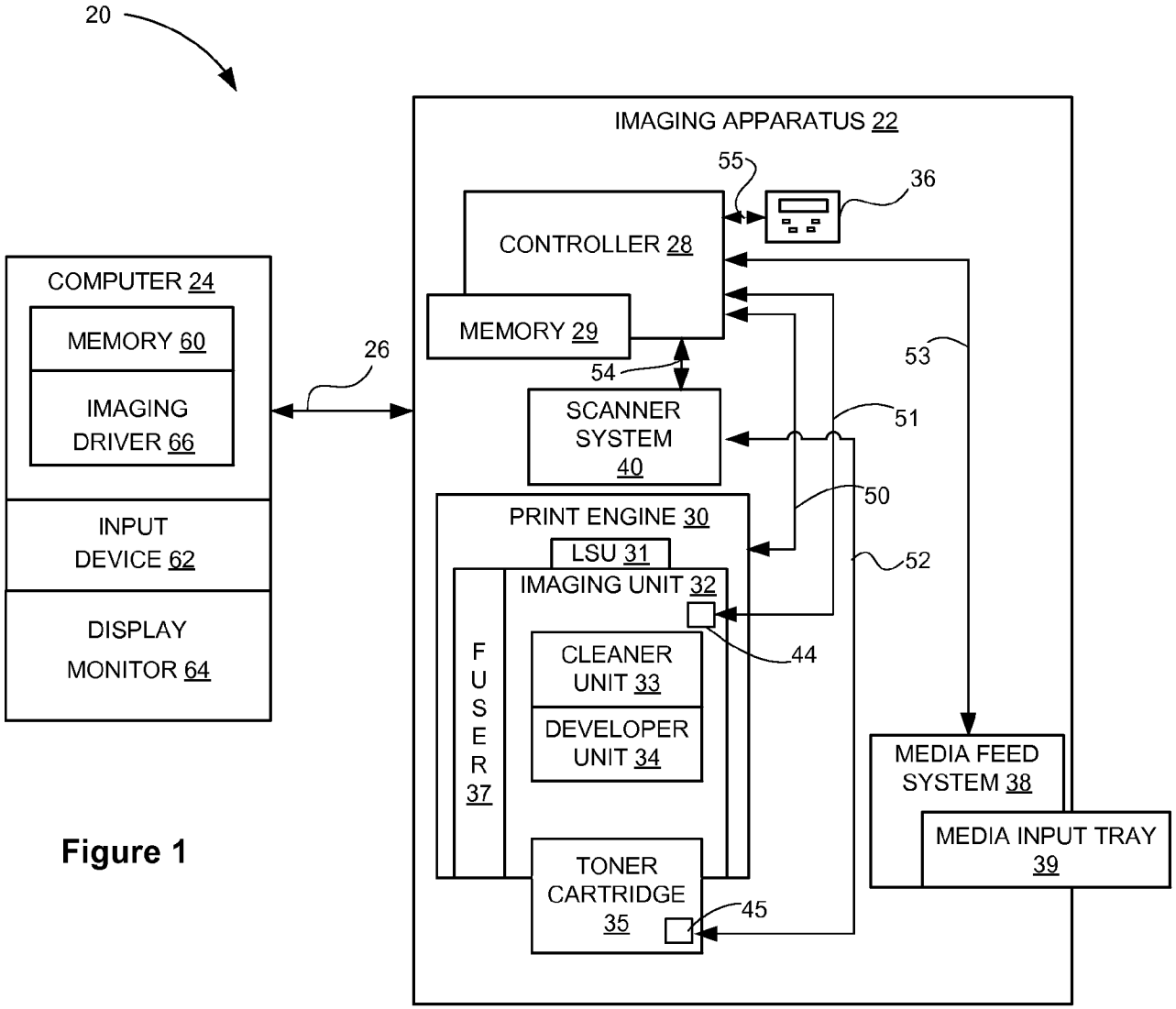
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program to instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum and developer unit 34 which is removably mounted within print engine 30 of imaging apparatus 32. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
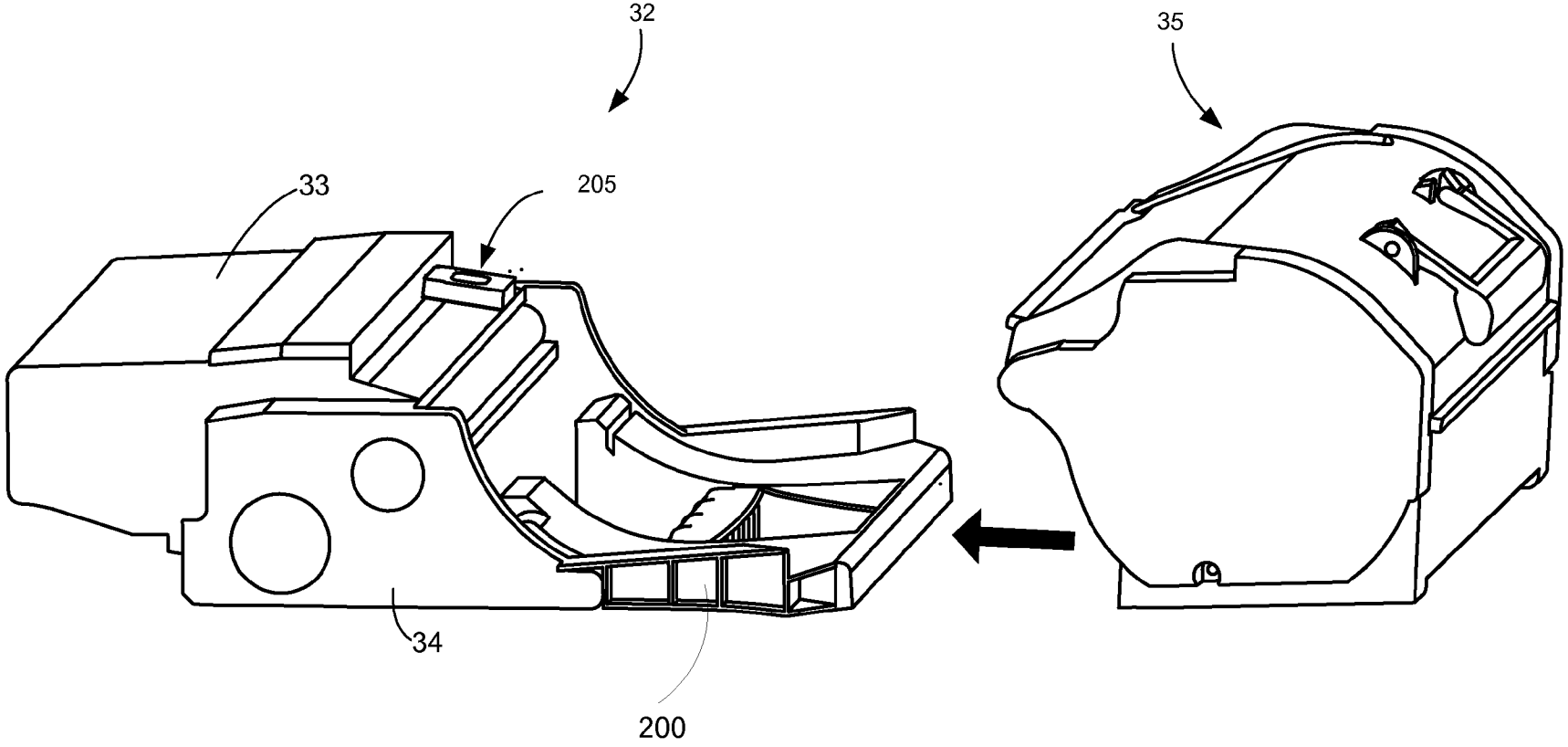
FIG. 2 is a perspective view of an imaging unit and toner cartridge of FIG. 1 in accordance with an example embodiment.

Referring now to FIG. 2, an example embodiment of imaging unit 32 is shown. Imaging unit 32, as illustrated, includes developer unit 34, cleaner unit 33 and a frame 200. Developer unit 34 and cleaner unit 33 are assembled onto or otherwise secured to frame 200. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. An exit port (not shown) on the toner cartridge 35 communicates with an inlet port 205 on the developer unit 34 allowing toner to be periodically transferred from the toner cartridge 35 to resupply the toner sump in the developer unit 34.

Figure 3:
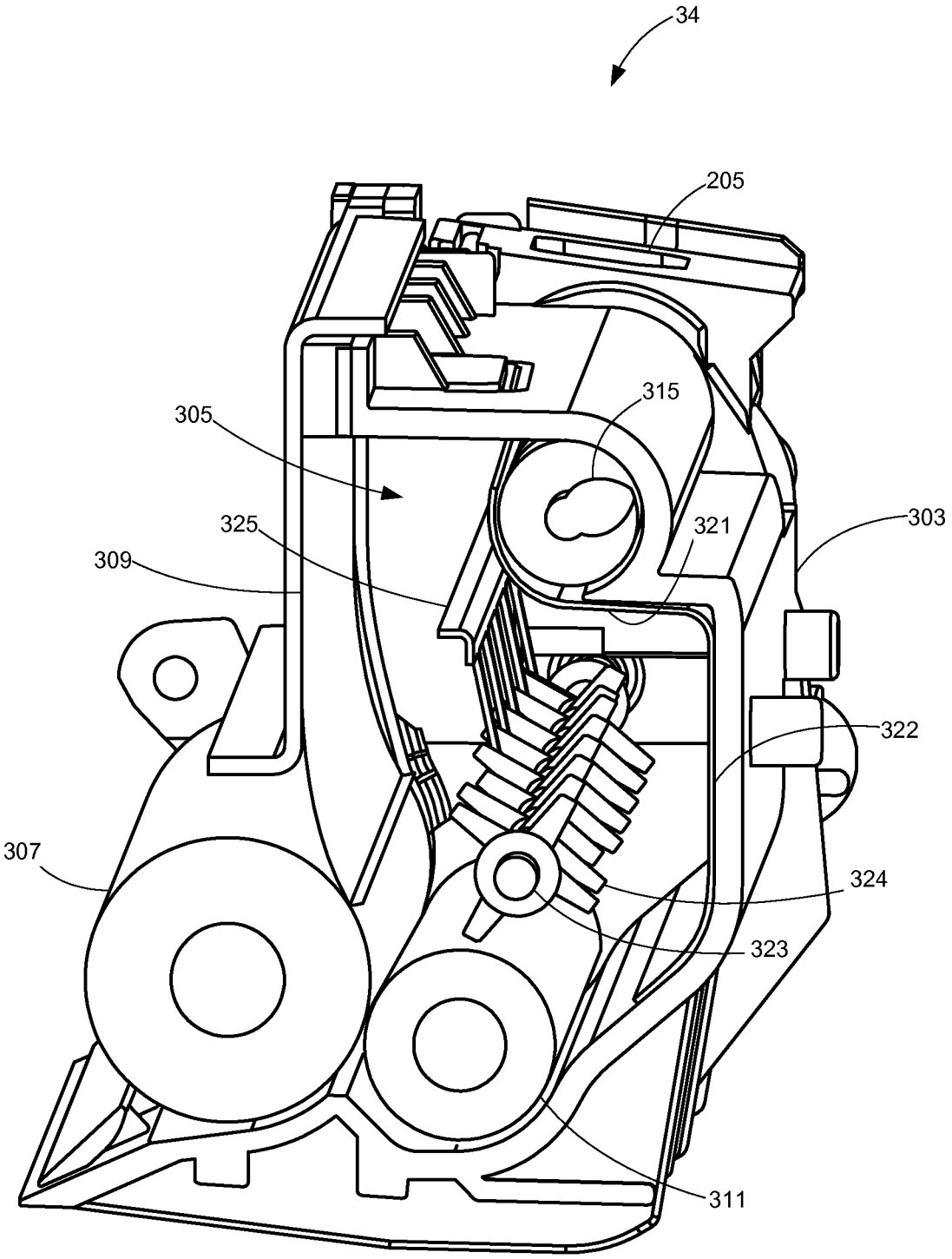
FIG. 3 is cross-sectional view of the developer unit of the imaging unit of FIG. 2 according to an example embodiment.

Referring now to FIG. 3, an example embodiment of the developer unit 34 is shown. Developer unit 34 includes a housing 303 enclosing a toner sump 305 sized to hold a quantity of toner. A developer roll 307, a doctor blade 309, and a toner adder roll 311 may be mounted within toner sump 305. The toner adder roll 311 moves the toner supplied from the toner cartridge 35 to developer roll 307 while the doctor blade 309 provides a metered, uniform layer of toner on developer roll 307. A rotating auger 315 and gutter 321 may be disposed along a side of the toner sump 305 proximal to toner inlet port 205 so as to distribute incoming toner substantially evenly across toner sump 305. A rotatable toner paddle or toner agitator 323 having one or more blades 324 may be positioned to stir and move toner within toner sump 305 to present to toner adder roll 311 and developer roll 307. In stirring and moving toner, rotating toner agitator 323 prevents toner particles from forming larger clumps within toner sump 305.

Toner inlet port 205 on housing 303 aligns with the exit port of toner cartridge 35 when toner cartridge 35 is installed along frame 200 and mated with developer unit 34. In one example form, toner inlet port 205 may be larger in area than the exit port of toner cartridge 35.

In accordance with example embodiments of the present disclosure, a toner level sensor may be positioned within the toner sump 305 for allowing for substantially continuous monitoring of the toner level therein. The toner level sensor may be implemented as a capacitive sensor. A capacitive toner level sensor serves to provide an indication of the relative toner levels contained therein. In an example embodiment, a three-plate capacitive toner level sensor is utilized. In particular, a first electrode is disposed in a largely central region of toner sump 305, spanning laterally across toner sump 305. Two second electrodes are disposed along opposed sides of toner sump 305 so that the centrally disposed first electrode is positioned in between the two second electrodes. The three electrodes form the three plates of the capacitive sensor, with the two second plates being electrically connected together. In this way, the three plates form two parallel connected capacitors. In the example embodiment, the first electrode may serve as a sense plate for sensing a capacitance value, indicating toner level within toner sump 305, and the two second electrodes may be driven by a voltage during a capacitive sensing operation. A three plate capacitive sensor advantageously provides enhanced sensitivity and improved performance, as explained in greater detail below.

Further, the capacitive toner level sensor may be implemented using existing components of developer unit 34. For example, the capacitive sensor may utilize mechanisms used in handling or otherwise controlling movement or position of toner within the toner sump 305. In the embodiment illustrated in FIG. 3, one of the second electrodes of the capacitive sensor may be implemented using the gutter 321 and back plate 322 which is disposed along a sidewall of toner sump 305 and which may be formed with gutter 321 from a single sheet of metal. In addition, a second one of the second electrodes of the capacitive sensor may be implemented using electrically conductive doctor blade 309, which is disposed along a sidewall of toner sump 305 opposite the sidewall having back plate 322. In this arrangement, the first electrode or sense plate 325 may be disposed between the combination of gutter 321 and back plate 322 and the doctor blade 309. The sense plate 325 may be disposed adjacent the toner agitator 323 and may have one or more slots formed through a body thereof to allow the blades 324 of the toner agitator 323 to pass through when being rotated. The gutter 321, back plate 322 and the doctor blade 309 may be electrically coupled to each other and driven by a common signal source, such as an AC voltage signal source. In the alternative, the gutter 321 and back plate 322 may be electrically insulated from doctor blade 309 and driven by separate voltage signal sources. As mentioned, sense plate 325 may be used to sense or measure signals indicative of toner level.

Figure 4A:
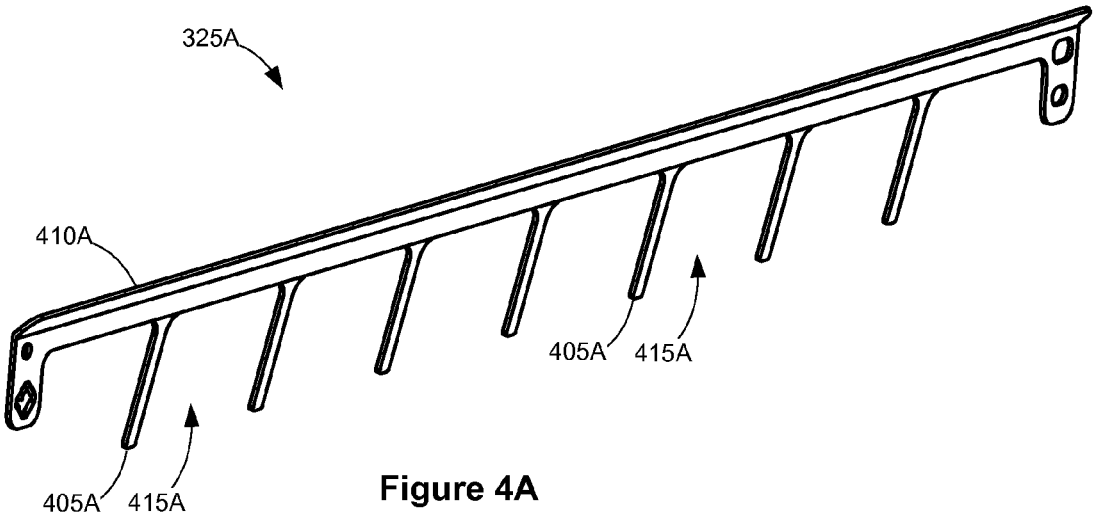
FIGS. 4A-4C illustrate example embodiments of a sense plate for the developer unit of FIG. 3.
Figure 4B:
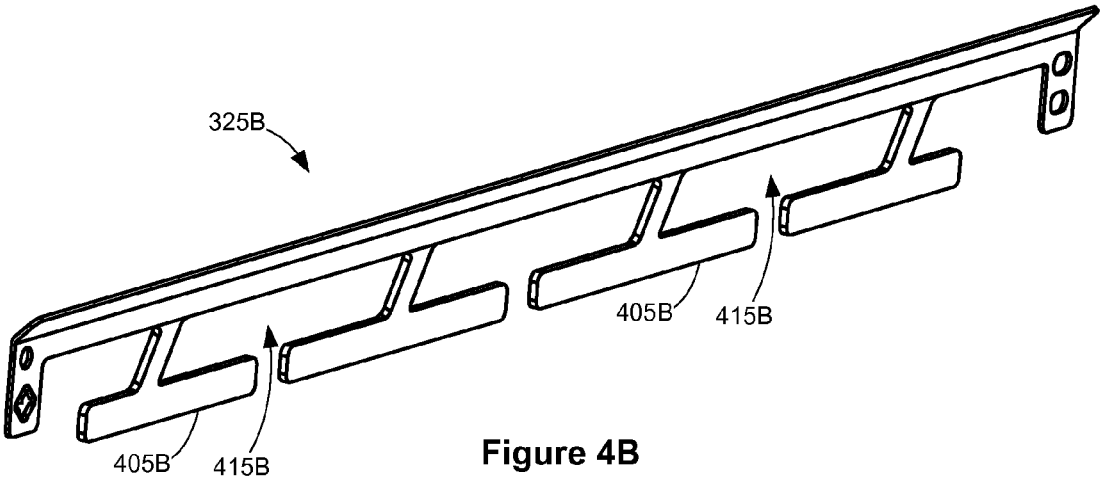
Figure 4C:
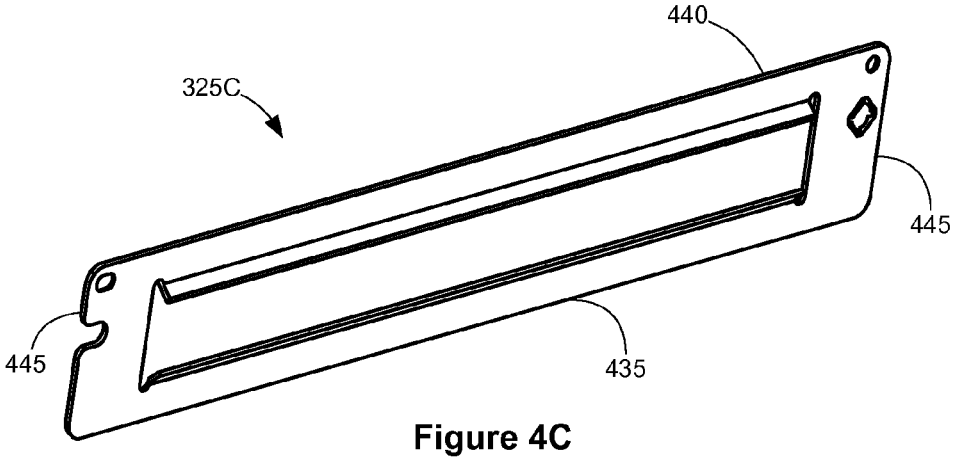
Figure 6:
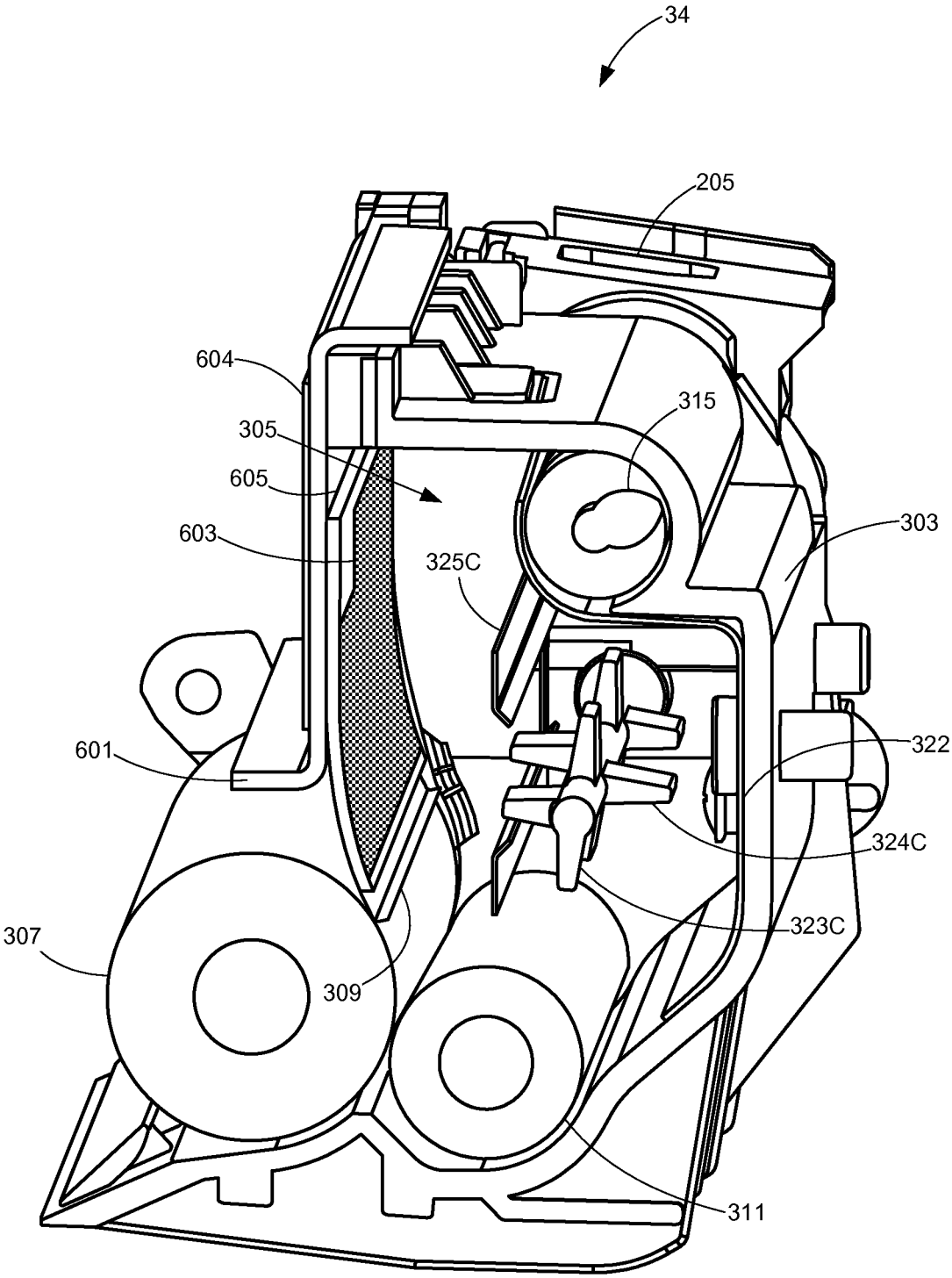
FIG. 6 is cross-sectional view of a developer unit of the imaging unit of FIG. 2 according to another example embodiment.

Sense plate 325 may have different shapes as shown, for example, in FIGS. 4A-4C. In FIG. 4A, sense plate 325A is formed in the shape of a comb structure having fingers 405A extending from an elongated plate portion 410A with adjacent fingers 405A separated by a distance forming slots 415A. In FIG. 4B, a modified comb structured sense plate 325B having substantially inverted T-shaped fingers 405B is shown. Such design may be used to increase the surface area of the sense plate 325. The sense plate 325 may also include plate portions placed at different positions to detect specific levels of toner. For example, as shown in FIG. 4C, the sense plate 325C may include a first plate portion 435 and a second plate portion 440 positioned above the first plate portion 435. First plate portion 435 and second plate portion 440 may be electrically coupled to each other via connecting members 445. In such a design, sense plate 325C may be able to sense toner positioned closer to the toner adder roll 311 as illustrated, for example, in FIG. 6 showing a cross-sectional view of developer unit 34 according to another example embodiment. In general, sense plate 325C may include multiple plate portions with each plate portion disposed at a position corresponding to a location of maximum capacitive change. Any type of conductive material may then be used to interconnect the multiple plate portions. It is further contemplated that other shapes or forms, including curved, cylindrical, coaxial, and other shapes as would occur to those skilled in the art may be implemented for the sense plate 325.

In order for the blades 324 of the toner agitator 323 to be able to pass through sense plate 325, the blades 324 may require shapes that fit into slots 415 formed between adjacent fingers 405 of the corresponding sense plate 325 while at the same time provide effective means to move toner and/or prevent toner from packing or clogging within toner sump 305.

Figure 5A:
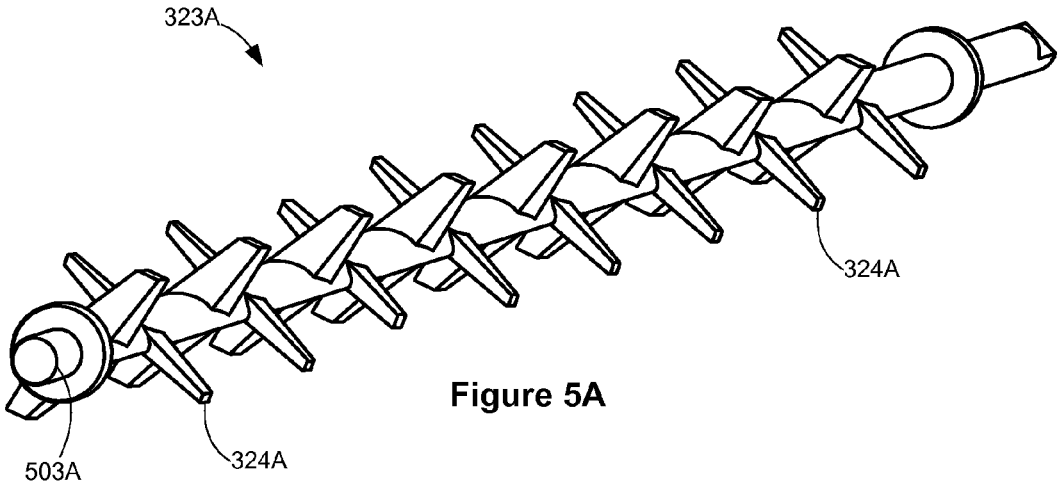
FIGS. 5A-5C illustrate example embodiments of a toner agitator for the developer unit of FIG. 3.
Figure 5B:
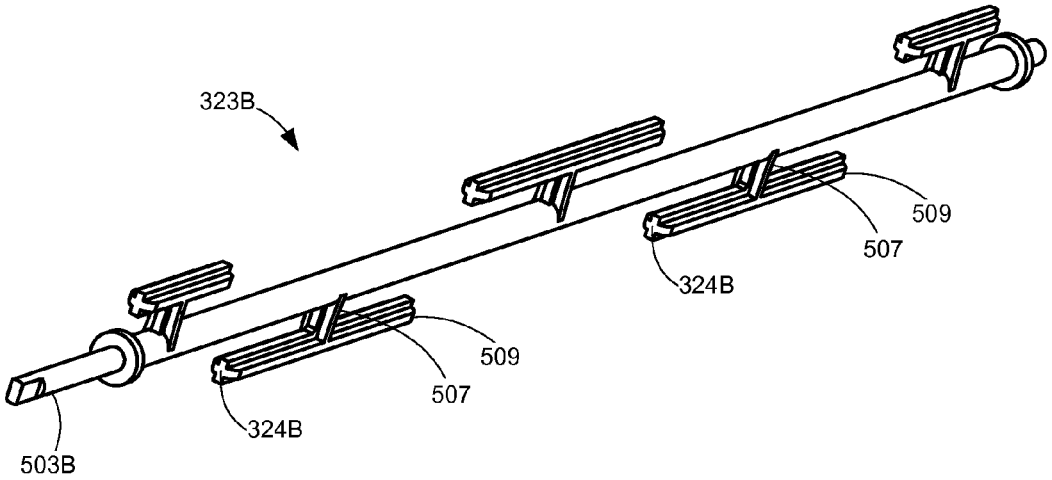
Figure 5C:
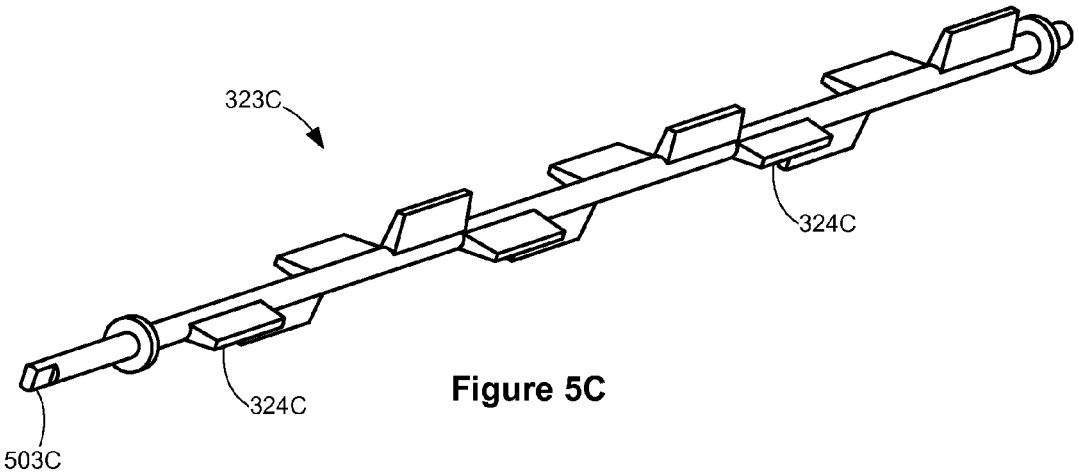

FIGS. 5A-5C show example embodiments of toner agitator structures that may be used with the sense plate designs shown in FIGS. 4A-4C. FIG. 5A illustrates toner agitator 323A having a drive shaft 503A and a plurality of axially spaced blades 324A extending radially outwardly from the drive shaft 503A. The axial spacing between adjacent blades 324A allows the blades 324A to pass through the slots 415A without being interfered with by the fingers 405A of the sense plate 325A. In FIG. 5B, each blade 324B of a toner agitator 323B is shaped to form a substantially T-shaped structure to conform to the shape of the slots 415B of the sense plate 325B shown in FIG. 4B. Each blade 324B includes a connecting bar 507 extending radially outwardly from drive shaft 503B and a breaker bar 509 extending from the connecting bar 507 in substantially parallel orientation with the drive shaft 503B. The connecting bars 507 and breaker bars 509 may have cross-shaped cross sections and a number of edges which may aid in chipping apart and driving through settled and/or compacted toner within toner sump 305. FIG. 5C shows toner agitator 323C comprised of a plurality of paddles or blades 324C radially extending from the drive shaft 503C and arranged in a substantially helical relationship along the drive shaft 503C with substantially no axial distance between adjacent blades 324C. Such toner agitator design may be used in to conjunction with the sense plate 325 in FIG. 4C as shown, for example, in FIG. 6. In other alternative embodiments, toner agitator 323 may be positioned to be sufficiently spaced from the sense plate 325 such that the blades 324 do not contact the sense plate 325 when being rotated to avoid the need for sense plate slots. It will be recognized that the blades 324 may be of other various geometrical shapes such as, for example, substantially cylindrical, rectangular, triangular, conical, etc., and may be of different lengths and/or dimensions, or angular orientation with respect to each other or relative to the drive shaft 503. It will also be appreciated that other combinations of sense plate 325 and toner agitator 323, and their arrangement relative to each other, may be implemented.

Regardless of the shape of sense plate 325, two capacitors are formed within the toner sump 305 in the example embodiment shown in FIG. 3. With the sense plate 325 acting as a common electrode, a first capacitor is formed between the sense plate 325 and the combination of gutter 321 and back plate 322, and a second capacitor is formed between the sense plate 325 and doctor blade 309. The first and second capacitors may be characterized by inherent capacitances C1 and C2, respectively, which may vary in response to amounts of toner existing between corresponding electrodes of the two capacitors. As the level of toner within the toner sump 305 rises, the toner displaces the air or gas between the respective electrodes of the first and second capacitors. The dielectric constant of toner is generally different from the dielectric constant of air. Thus, changes in the value of the capacitances C1 and C2 occur due to a change in the composite dielectric constant of the substance between the respective electrodes of the two capacitors.

Generally, the capacitance relationship for a two plate capacitor can be approximated by a capacitor with two closely spaced parallel plates, which may be expressed by:

$$C = 8.854\ \text{pF/m} * K * \left(\frac{A}{D}\right)$$

where C is capacitance in picoFarads, K is the relative dielectric constant of the material filling the space between two electrodes in farads per meter, A is the area of overlap between the two electrodes in square meters, and D is the distance between the two electrodes in meters. The dielectric constant K is a numerical value that relates to the ability of the material between the electrodes to store an electrostatic charge. According to the above equation, if a higher dielectric material replaces a lower one, the total capacitance increases. Furthermore, an increase in electrode area A and/or a decrease in separation distance D will each produce an increase in capacitance.

By positioning the sense plate 325 between the doctor blade 309 and the combination of the gutter 321 and the back plate 322, the surface area of the sense plate 325 is maximized with each of the first and second capacitors utilizing one side surface area of the sense plate 325. At the same time, the separation distances between the sense plate 325 and the driven plates (gutter 321/back plate 322 and doctor blade 309) are halved. Furthermore, the first and second capacitors may be represented as two capacitors connected in parallel when embodied in circuit form. As a result, the total capacitance is the sum of capacitances C1 and C2 of the first and second capacitors, respectively. Accordingly, due to the increased surface area, decrease in separation distance, and parallel circuit equivalence of the two capacitors, the resulting capacitance and/or capacitance variation that may be obtained by the three-plate capacitive toner level sensor is increased compared to a standard two plate capacitor design.

In addition, positioning the sense plate 325 in the middle portion of the toner sump 305 between gutter 321/back plate 322 and doctor blade 309 provides the sense plate 325 a sufficient amount of shielding which may reduce and/or block electrical interference, electromagnetic interference or other noise from other external sources. Shielding may cause signals sensed or measured on sense plate 325 to be less susceptible to other signals, such as AC voltages, used to operate surrounding components or devices within or external to imaging apparatus 22, thereby advantageously allowing the three-plate capacitive toner level sensor to perform its functions with a higher degree of accuracy.

The sense plate 325 may be electrically coupled to a sensing circuitry (not shown) for receiving electrical signals appearing on sense plate 325 and determining the instantaneous capacitance of the first and second capacitors. Such circuitry may be located in imaging unit 32, print engine 30, controller 28 or some or all thereof. Once the resulting capacitance of the first and second capacitors is determined, the amount of toner that exists within toner sump 305 may be determined using, for example, correlation data. Due to the increased capacitance and/or capacitance variation readings, higher sensitivity to small changes in toner level and higher resolution of toner measurement may be achieved.

In another example embodiment, a capacitive toner level sensor in toner sump 305 may be implemented using only the doctor blade 309 and the combination of gutter 321 and back plate 322 without sense plate 325. For example, the gutter 321/back plate 322 combination may be used as a conductive electrode to be driven by a signal source while the doctor blade 309 may be used to sense or measure signals indicative of toner level, or vice versa. The gutter 321/back plate 322 combination and doctor blade 309 may form a capacitor characterized by an inherent capacitance that varies in response to an amount of toner existing therebetween. In one embodiment, the gutter 321/back plate 322 combination or the doctor blade 309 may be electrically coupled to the above mentioned sensing circuitry to detect instantaneous capacitance of the capacitor and determine the amount of toner that exists between the two conductive plates. Although sensitivity of such design may be lower compared that of the three-plate design, the design takes advantage of existing components within the toner sump 305 by combining toner control and sensor functions of existing components.

It is understood that other electrically conductive component or mechanism within toner sump 305 may be used as at least a portion of at least one conductive electrode of the capacitive toner level sensor. For example, the toner agitator may alternatively be used as a sense plate instead of or in addition to sense plate 325. In another example embodiment, a drive plate may be attached to and/or made a part of the doctor blade assembly, such as a bracket 601 mounting doctor blade 309 (FIG. 6). In yet another example embodiment, additional plates or conductive materials may be incorporated within toner sump 305 for use as conductive plates of the capacitive sensor. For example, a drive plate 603 may be disposed in front of and insulated from the doctor blade 309 by an insulating material 605. Alternatively, a separate drive plate 604 may be positioned behind the doctor blade 309, such as behind bracket 601 or between doctor blade 309 and bracket 601 (not shown). In other example embodiments, the inner or outer walls of the toner sump 305 may be lined or molded with electrically conductive material for use as conductive plates of the capacitive sensor. It will be appreciated that other arrangements and/or locations of drive plates may be utilized.

In another example embodiment, more than three plates may be used as conductive electrodes of the capacitive toner level sensor of the toner sump 305. In one embodiment, additional electrodes may be positioned within a central portion of the toner sump 305 in addition to the sense plate 325. Additional conductive plates/electrodes or existing components within toner sump 305 may be used as driven plates in addition to the gutter 321/back plate 322 and the doctor blade 309. Each adjacent electrode may form a capacitor exhibiting a capacitance that varies depending on the amount of toner existing between electrodes. In an example embodiment, alternate plates/electrodes may be connected to two separate terminals. For example, a first set of electrodes may be electrically coupled to a first terminal which is driven by a signal source while a second set of electrodes alternating with the first set of electrodes may be coupled to one or more second terminals and used as sense electrodes. The second terminals may then be electrically coupled to the sensing circuitry to detect instantaneous capacitances of the multi-plate capacitor. It will be appreciated that as the number of capacitor plates is increased, the overall sensor capacitance is also increased due to a further increase in surface area and decrease in separation distance between adjacent electrodes. Accordingly, a capacitive sensor utilizing multiple plates may yield significantly higher sensitivity and higher resolution in a small volume of container than does a standard two-plate capacitive sensor design.

The description of the details of the example embodiments have been described in the context of the toner sump. However, it will be appreciated that the teachings and concepts provided herein are applicable to other toner containers as well.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A container for containing toner, comprising:

a first electrode;

a roller disposed within the container;

a doctor blade positioned in proximity to the roller for removing or smoothing at least a part of a toner layer on the roller, wherein the doctor blade forms a second electrode, the first and second electrodes forming a capacitor having a capacitance that changes in response to a change in an amount of toner existing in the container between the first and second electrodes;

a third electrode disposed in the container such that the first electrode is positioned between the second and third electrodes, the first and third electrodes forming a second capacitor having a capacitance that changes in response to a change in an amount of toner existing in the container between the first and third electrodes; and a toner inlet for receiving toner, an auger disposed relative to the inlet for distributing toner within the container which passes through the inlet, and a gutter disposed beneath the auger, wherein the third electrode comprises the gutter.

2. The container of claim 1, wherein the first electrode is disposed in a central portion of the container.

3. The container of claim 1, wherein the second and third electrodes at least partly surround the first electrode so as to provide electrical shielding thereto.

4. The container of claim 1, wherein at least a portion of the first electrode, the second electrode and the third electrode are disposed substantially in parallel with each other.

5. The container of claim 1, wherein the first electrode includes a first portion and one or more finger members which extend from the first portion.

6. A container for holding toner, comprising:

a first electrode disposed within the container;

a second electrode electrically connected to the first electrode and disposed within the container opposite the first electrode; and a sense electrode disposed between the first electrode and the second electrode, the sense electrode and the first electrode forming a first capacitor having a first capacitance that changes in response to a change in toner amount existing therebetween, and the sense electrode and the second electrode forming a second capacitor having a second capacitance that changes in response to a change in toner amount existing therebetween;

wherein the sense electrode includes a first portion and a plurality of finger members which extend from the first portion.

7. The container of claim 6, wherein each finger member comprises a substantially inverted T-shaped finger.

8. The container of claim 6, further comprising a movable toner agitator having one or more blades sized for passing through the plurality of finger members when the toner agitator is moved.

9. The container of claim 6, further comprising a roller and a doctor blade positioned in proximity to the roller for removing or smoothing at least a part of a layer of toner on the roller, the doctor blade forming at least part of the second electrode.

10. The container of claim 6, wherein the sense electrode is positioned substantially midway between the first and second electrodes.

11. The container of claim 6, further comprising a toner inlet for receiving toner, an auger disposed relative to the inlet for distributing toner within the container that passes through the inlet, and a gutter disposed beneath the auger, wherein the first electrode comprises the gutter.

12. A container for holding toner, comprising:

a plurality of electrodes disposed within the container and including at least two first electrodes and at least one second electrode, the plurality of electrodes forming at least two capacitors having capacitances that change in response to a change in an amount of toner existing within the container;

wherein the at least one second electrode is positioned at a central portion within the container and the at least two first electrodes are positioned to at least partly surround the at least one second electrode so as to provide electrical shielding thereto; and wherein the at least one second electrode has a plate portion and a plurality of finger members extending therefrom, the container further comprising a toner agitator having blades that, when the toner agitator is rotated, pass through spaces between adjacent fingers of the at least one second electrode.

13. The container of claim 12, wherein each finger member comprises a substantially inverted T-shaped finger member.

14. The container of claim 12, wherein each of the blades of the toner agitator is substantially T-shaped.

15. The container of claim 12, further comprising a toner inlet, an auger disposed relative to the toner inlet for moving toner that passes through the toner inlet, and a gutter positioned beneath the auger within the container, the gutter forming at least part of one of the first electrodes.

16. The container of claim 12, further comprising a roller disposed within the container and a doctor blade positioned in proximity to the roller for removing a part of a layer of toner on the roller, the doctor blade forming at least part of one of the first electrodes.

17. The container of claim 12, wherein at least a portion of the first and second electrodes extend substantially parallel to each other.

18. A container for containing toner, comprising:

a first electrode;

a roller disposed within the container;

a doctor blade positioned in proximity to the roller for removing or smoothing at least a part of a toner layer on the roller, wherein the doctor blade forms a second electrode, the first and second electrodes forming a capacitor having a capacitance that changes in response to a change in an amount of toner existing in the container between the first and second electrodes; and a toner inlet for receiving toner, an auger disposed relative to the inlet for distributing toner within the container that passes through the inlet, and a gutter disposed beneath the auger, wherein the first electrode comprises the gutter.

19. A container for holding toner, comprising:

a plurality of electrodes disposed within the container and including at least two first electrodes and at least one second electrode, the plurality of electrodes forming at least two capacitors having capacitances that change in response to a change in an amount of toner existing within the container;

wherein the at least one second electrode is positioned at a central portion within the toner container and the at least two first electrodes are positioned to at least partly surround the at least one second electrode so as to provide electrical shielding thereto; and a toner inlet, an auger disposed relative to the toner inlet for moving toner that passes through the toner inlet, and a gutter positioned beneath the auger within the toner container, the gutter forming at least part of one of the first electrodes.

* * * * *